US011669026B2

(12) United States Patent
Aoyama

(10) Patent No.: US 11,669,026 B2
(45) Date of Patent: Jun. 6, 2023

(54) IMAGE FORMING APPARATUS INCLUDING A DOWNSTREAM BELT PRESSER FROM AN EXTERNAL SIDE

(71) Applicant: SHARP KABUSHIKI KAISHA, Osaka (JP)

(72) Inventor: Junya Aoyama, Sakai (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 17/494,197

(22) Filed: Oct. 5, 2021

(65) Prior Publication Data

US 2022/0113655 A1 Apr. 14, 2022

(30) Foreign Application Priority Data

Oct. 8, 2020 (JP) ..... JP2020-170736

(51) Int. Cl.
*G03G 15/16* (2006.01)

(52) U.S. Cl.
CPC ..... *G03G 15/1605* (2013.01)

(58) Field of Classification Search
CPC ..... G03G 15/1605; G03G 15/161; G03G 15/1615; G03G 15/165; G03G 15/1655; G03G 15/167
See application file for complete search history.

(56) References Cited

U.S. PATENT DOCUMENTS 9,933,729 B2 * 4/2018 Miyakoshi ..... G03G 15/1605
2013/0011158 A1 * 1/2013 Meguro ..... G03G 21/007 399/101

FOREIGN PATENT DOCUMENTS

JP 2004029214 A * 1/2004
JP 2009-204761 A 9/2009
JP 2011248320 A * 12/2011

* cited by examiner

*Primary Examiner* — Arlene Heredia
(74) *Attorney, Agent, or Firm* — ScienBiziP, P.C.

(57) ABSTRACT

A transcriber includes an intermediate transfer belt, a driving roller being in contact with an internal surface of the intermediate transfer belt and to circulate it, a plurality of primary transfer members to primarily transfer toner images formed by image formers onto an external surface of the intermediate transfer belt, a secondary transfer member disposed so as to abut on the intermediate transfer belt on the driving roller and to secondarily transfer the toner images that are primarily transferred onto the intermediate transfer belt onto a sheet, and a belt presser pressed against the intermediate transfer belt on a downstream side from a position where the secondary transfer member abuts on the intermediate transfer belt in a circulation direction thereof and from an external side of the intermediate transfer belt, wherein when not forming the images, the belt presser is released from the intermediate transfer belt.

9 Claims, 8 Drawing Sheets

IMAGE FORMING APPARATUS INCLUDING A DOWNSTREAM BELT PRESSER FROM AN EXTERNAL SIDE

BACKGROUND OF THE INVENTION

Field of the Invention

The present invention relates to a transcriber and an image forming apparatus including the same.

Description of the Background Art

As a transcriber, a so-called tandem type transcriber, in which after toner images of different colors each formed on a plurality of image carriers are superimposed on an intermediate transfer belt to perform a primary transfer, the superimposed toner images are transferred to a sheet at once to perform a secondary transfer, is known. In such a tandem type, it is necessary to precisely superimpose the toner images of the different colors on the intermediate transfer belt.

As a means of improving the preciseness of superimposing the toner images of the different colors, there is a means for suppressing a circulating slippage (slip) of the intermediate transfer belt by applying dynamic friction force to a circulation of the intermediate transfer belt. By providing a belt presser to be pressed against the intermediate transfer belt, it is possible to generate the dynamic friction force against the circulating movement of the intermediate transfer belt at the contact surface between the intermediate transfer belt and the belt presser. In addition, by configuring the belt presser so as to be pressed against the intermediate transfer belt from an external surface of the intermediate transfer belt, a location space of the belt presser is saved (see, Japanese Patent Laid-open Publication No. 2009-204761, for example).

Conventional intermediate transfer belt is being pressed by the belt presser even when no image is formed. In the case where no image is formed for a long period, there has been a problem that the intermediate transfer belt is deformed by a continuous load from the belt presser. If the intermediate transfer belt is deformed, it make the intermediate transfer belt difficult to circulate stably, so that it reduces the preciseness of the superimposing of the toner images of the different colors and thus degrades a quality of the image to be secondarily transferred to the sheet.

The present invention was made to solve the above mentioned conventional problems, and it is objects of the present invention to provide a transcriber capable of suppressing slippage of an intermediate transfer belt as well as avoiding deformation of the intermediate transfer belt, and provide an image forming apparatus including such a transcriber.

SUMMARY OF THE INVENTION

In order to achieve the above mentioned objects, according to an aspect of the present invention a transcriber is provided, and the transcriber includes: an endless intermediate transfer belt; a driving roller being in contact with an internal surface of the intermediate transfer belt and to circulate the intermediate transfer belt; a plurality of primary transfer members to respectively primarily transfer toner images formed by a plurality of image formers onto an external surface of the intermediate transfer belt; a secondary transfer member disposed so as to abut on the external surface of the intermediate transfer belt on the driving roller and to secondarily transfer the toner images that are primarily transferred onto the external surface of the intermediate transfer belt onto a sheet; and a belt presser pressed against the intermediate transfer belt on a downstream side from a position where the secondary transfer member abuts on the intermediate transfer belt in a circulation direction of the intermediate transfer belt and from an external of the intermediate transfer belt, wherein when not forming the images, the belt presser is released from the intermediate transfer belt.

Furthermore, in the transcriber when the belt presser is pressed against the intermediate transfer belt, the belt presser may be abutted to the driving roller via the intermediate transfer belt.

Furthermore, in the transcriber the belt presser may be pressed against the intermediate transfer belt so as to direct toward the driving roller.

Furthermore, in the transcriber a position where the belt presser is pressed against the intermediate transfer belt may be on a downstream side from a contact area between the intermediate transfer belt and the driving roller in the circulation direction of the intermediate transfer belt.

Furthermore, in the transcriber when forming the images, a contact area between the driving roller and the intermediate transfer belt may increase as compared to when not forming the images.

Furthermore, in the transcriber an elastic layer may be provided at a portion of the belt presser that is pressed against the intermediate transfer belt.

Furthermore, the transcriber further includes a transfer member contact/releaser to reciprocally move the plurality of primary transfer members in a direction approaching or leaving image carriers, respectively; the belt presser may be pressed against or released from the intermediate transfer belt by the transfer member contact/releaser.

Furthermore, in the transcriber the sheet is transported with being sandwiched between the intermediate transfer belt on the driving roller and the secondary transfer member, and an outer diameter of the driving roller may be smaller than an outer diameter of the secondary transfer member.

Furthermore, the transcriber may further include an abutting member provided on a downstream side from the belt presser in the circulation direction of the intermediate transfer belt, and abutted on the internal surface of the intermediate transfer belt.

Furthermore, the transcriber further includes an image reader provided on a downstream side from the belt presser in the circulation direction of the intermediate transfer belt and to read a toner image for a test formed on the intermediate transfer belt, and the belt presser may be not in contact with a portion where the toner image for a test is formed on the intermediate transfer belt.

Furthermore, according to another aspect of the present invention, an image forming apparatus is provided, and the image forming apparatus includes the above described transcriber.

According to the present invention, when forming the image, by generating the dynamic friction force against the circulation of the intermediate transfer belt by pressing the belt presser 66 thereto, it results in effects that the slippage of the intermediate transfer belt can be suppressed, as well as the preciseness of the image formation can be improved, on the other hand, when not forming the image, since the load on the intermediate transfer belt is decreased by releasing the belt presser 66 therefrom, the deformation of the intermediate transfer belt can be avoided, and thus a precise degradation of the image formation can be suppressed.

DESCRIPTION OF THE PREFERRED EMBODIMENTS

Now, embodiments of the present invention are described with reference to the accompanying drawings. In the following description, the same parts or the like are denoted by an identical numerical number, as well as the names and functions thereof are the same. Therefore, detailed descriptions of those parts or the like are omitted.

Embodiment 1

Image Forming Apparatus

Figure 1:
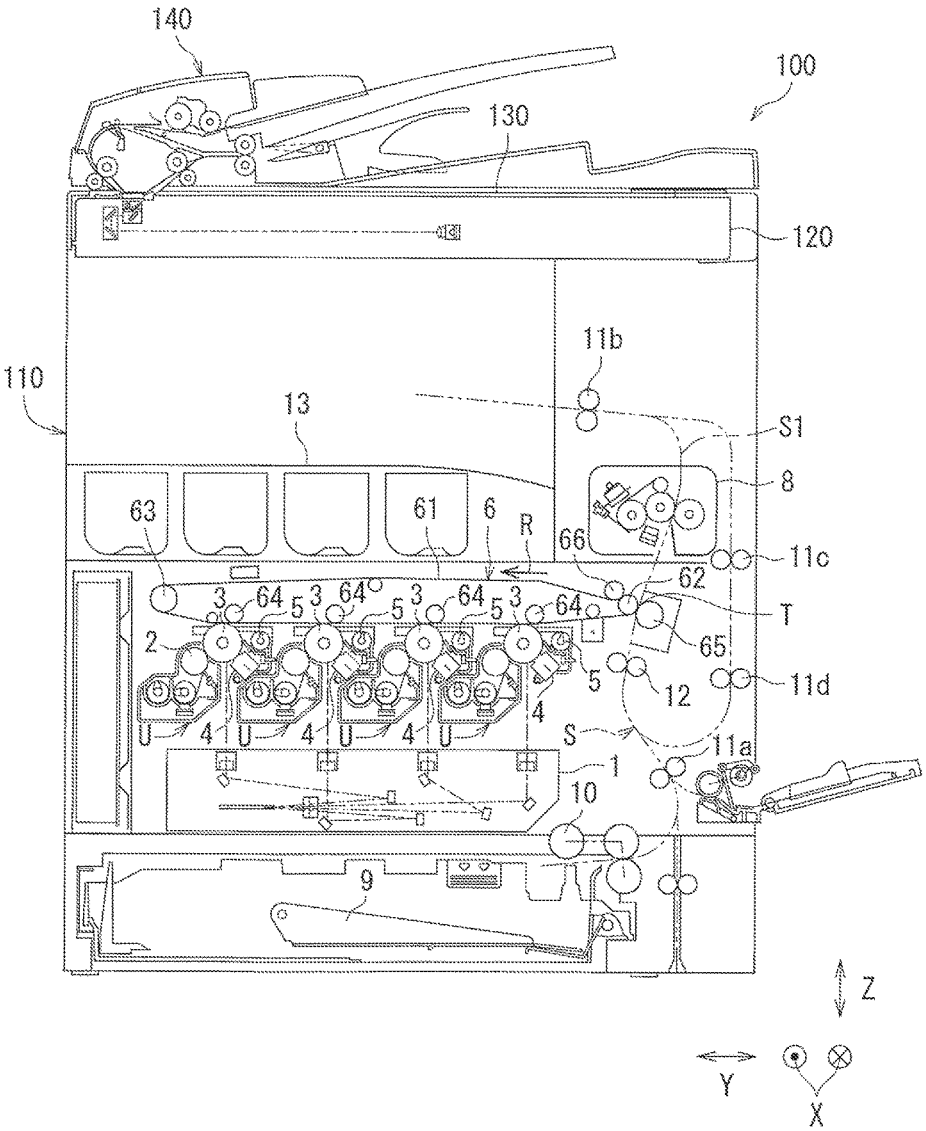
FIG. 1 is a schematic cross-sectional view illustrating a configuration of an image forming apparatus according to an embodiment 1.

FIG. 1 is a schematic cross-sectional view illustrating a configuration of an image forming apparatus 100 according to an embodiment 1. In the drawings, a reference character X indicates a width direction a depth direction), in which a −X direction (i.e., a minus X direction) defines a front direction and a +X direction (i.e., a plus X direction) defines the rear direction. The reference character Y indicates a left and right direction orthogonal to the width direction X, in which a −Y direction (i.e., a minus Y direction) defines a left direction and a +Y direction (i.e., a plus Y direction) defines the right direction. The reference character Z indicates an up and down direction, in which a −Z direction (i.e., a minus Z direction) defines a downward direction and a +Z direction (i.e., a plus Z direction) defines the upward direction.

A body 110 of the image forming apparatus 100 includes an exposure device 1, a developing device 2, an image carrier 3, a charger 4, a cleaning unit 5, a transcriber 6, a fusing device 8, a paper feeding cassette 9, a pickup roller 10, transport rollers 11*a*, 11*b*, 11*c*, and 11*d*, a resist roller 12, and a discharging part 13 (see FIG. 1). The body 110 is provided with a transport path S for transporting sheets supplied one by one from the paper feeding cassette 9 (see FIG. 1).

The exposure device 1 exposes a surface of a charged image carrier 3 in response to an input image data so as to form an electrostatic latent image on the surface of the image carrier 3 according to the image data. There are arranged in the exposure device 1 a polygon mirror for scanning a laser beam and optical elements such as lenses, mirrors and the like for guiding the laser beam reflected by the polygon mirror to the image carrier 3. The developing device 2 develops (visualizes) the electrostatic latent images formed on the surfaces of the image carriers 3 with toners of four colors (1 (yellow), M (magenta), C (cyan) and K (black)), respectively. The image carrier 3 conveys the toner image developed by the developing device 2 to the transcriber 6. The charger 4 uniformly charges the surface of the image carrier 3 to a predetermined potential.

As the charger 4, a contact-type charger (e.g., a roller-type or brush-type charger) or a charging-type charger can be used, for example.

The cleaning unit 5 removes a residual toner remaining on the surface of the image carrier 3 after developing and transferring the image.

An image former U is composed of the exposure device 1, the developing device 2, the image carrier 3, the charger 4, and the cleaning unit 5 above mentioned. The image former U serves to form the toner image.

The transcriber 6, on which the toner images of the different colors formed on the image carriers 3 are transferred in a superimposed state, is disposed above the image carriers 3. Specifically, a primary transfer member 64 of the transcriber 6 provides a transfer bias to an intermediate transfer belt 61 of the transcriber 6, so that the toner image of the image carrier 3 is transferred onto the intermediate transfer belt 61 (i.e., an external surface of the intermediate transfer belt 61). Hereafter, transferring the toner images of the different colors formed on the image carriers 3 onto the intermediate transfer belt 61 is referred to as "a primary transfer."

The toner image transferred onto the intermediate transfer belt 61 is transported to a secondary transfer member 65 by a circulating movement of the intermediate transfer belt 61.

The secondary transfer member 65 is disposed so as to contact the external surface of the intermediate transfer belt 61 on a driving roller 62, and secondarily transfers to the sheet the toner image which has been primarily transferred to the external surface of the intermediate transfer belt 61. A voltage, which is a voltage for transferring the toner image on the intermediate transfer belt 61 onto the sheet, that is, a voltage with a polarity (e.g., a positive polarity) reverse to a toner's charged polarity (e.g., a negative polarity), is applied to the secondary transfer member 65.

Hereafter, transferring the toner image transferred on the intermediate transfer belt 61 onto the sheet is referred to as "a secondary transfer."

The fusing device 8 heats and melts the toner image transferred onto the sheet by fixing it to the sheet in order to fuse the toner image onto the sheet.

The paper feeding cassette 9 is disposed on the lower side of the body 110, and stores sheets P to be used for the image formation. The pickup roller 10 pulls out a sheet of paper (sheet P) at a top layer of a paper bundle in the paper feeding cassette 9 and transports it to a main transport path S1. The transport rollers 11*a*, 11*b*, 11*c*, and 11*d* transport the sheet P along the transport path S. The resist roller 12 temporarily stops the sheet P which is being transported from the paper feeding cassette 9 to perform positioning of a tip end of the sheet P. In addition, the resist roller 12 functions to transport the sheet P with good timing in synchronization with a movement of the image formed on the intermediate transfer belt 61.

The discharging part 13 is provided on the upper side of the body 110 and to discharge face down the sheet P on which the image has been formed.

A document reading device 120 is provided at the upmost part of the body 110. A document laying table 130 made of transparent glass is provided on the document reading device 120. An automatic document processing unit 140 is installed on the document laying table 130. The image of a document is read by the document reading device 120 with the document being laid on the document laying table 130 or with the document being automatically transported to the document reading device 120 by the automatic document processing unit 140.

The image forming apparatus 100 is configured to form a multicolor or monochromatic image on the sheet P in accordance with either image data corresponding to the document read by the document reader 120 or image data received externally.

The image forming apparatus 100 can handle either image data corresponding to a color image using black (K), cyan (C), magenta (M), and yellow (Y), or image data corresponding to a monochrome image using a single color (e.g. black). Accordingly, the image former U (i.e., the developing device 2, the image carrier 3, the charger 4, and the cleaning unit 5) and the primary transfer member 64 are provided one each for one color (see FIG. 1).

In the image forming apparatus 100 described above, when a single-sided image formation is requested, the sheet P transported from the paper feeding cassette 9 is first transported to the resist roller 12 by the transport roller 11*a* on the main transport path S1. Next, the sheet P is transported by the resist roller 12 to a transfer position in synchronization with the movement of the toner image formed on the intermediate transfer belt 61. The toner image on the intermediate transfer belt 61 is transferred onto the sheet P which has been transported to the transfer position. Then, the toner is fused on the sheet P by the fusing device 8. The sheet P on which the toner image has been fused is then discharged onto the discharging part 13 passing through the transport roller 11*b*.

Transcriber

Next, the transcriber 6 is described in detail.

Figure 2:
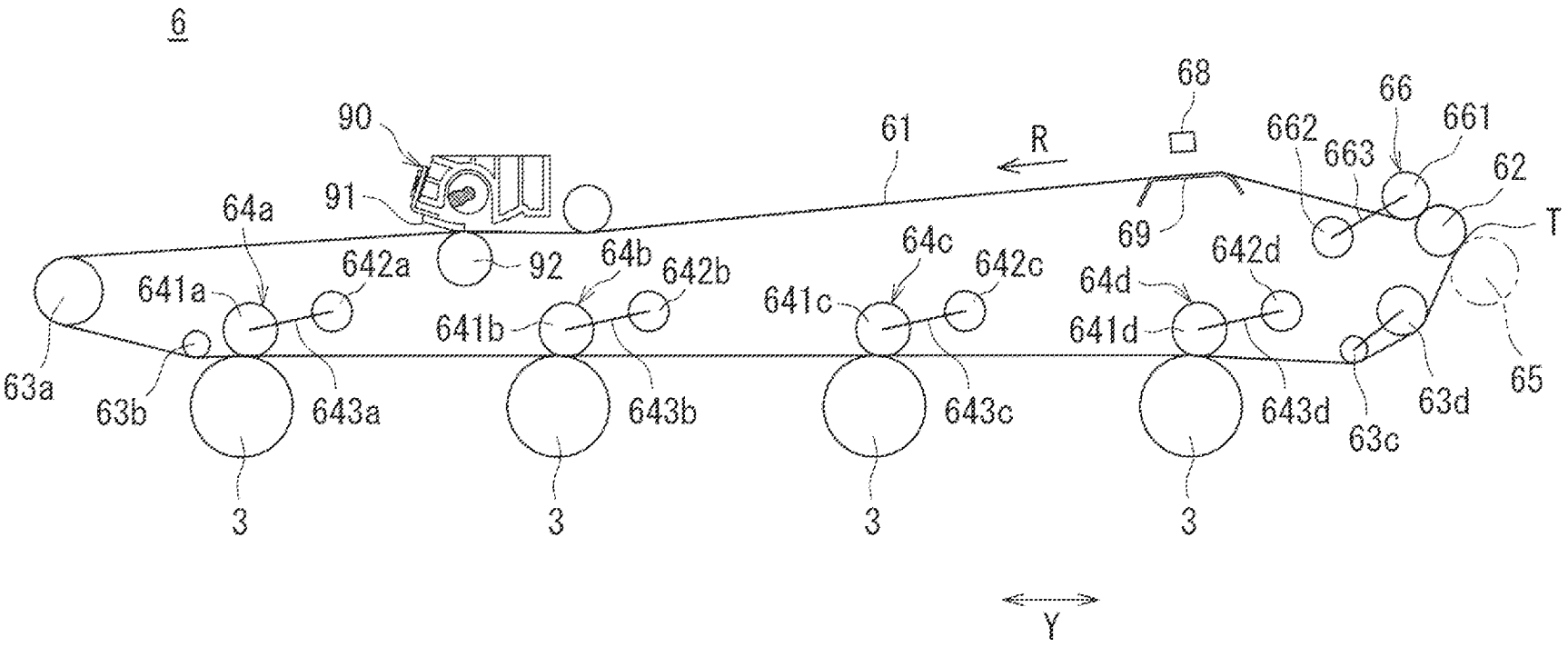
FIG. 2 is a schematic front view illustrating a configuration of a transcriber according to the embodiment 1.
Figure 3:
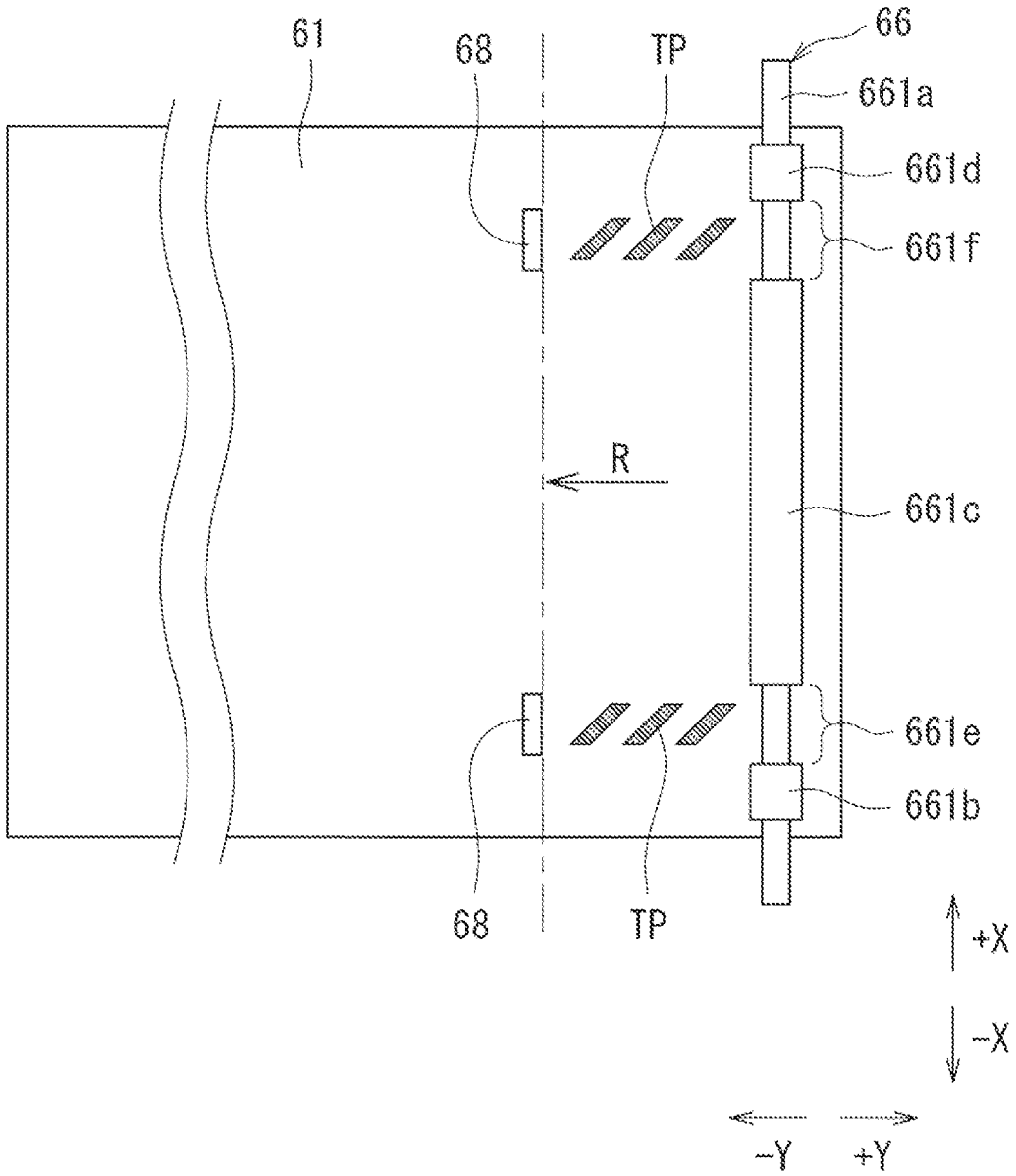
FIG. 3 is a schematic plan view illustrating an intermediate transfer belt and a belt presser.
Figure 4:
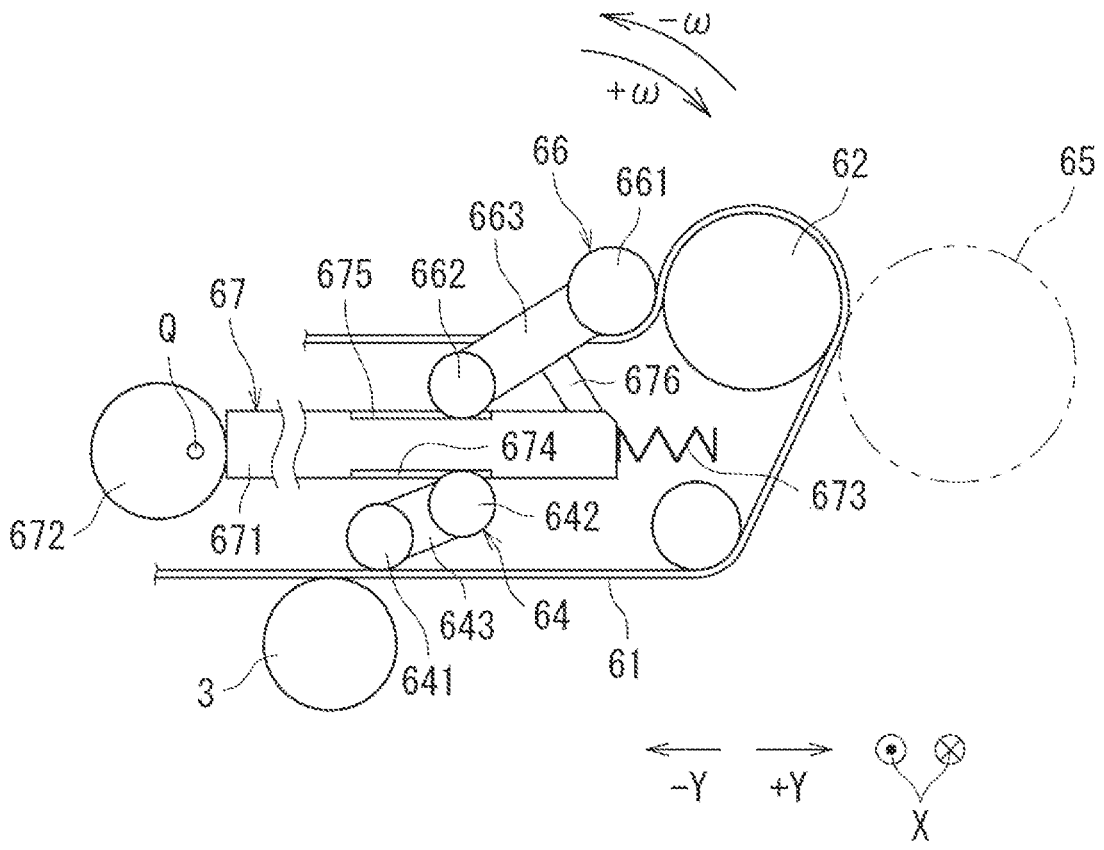
FIG. 4 is a schematic front view illustrating a portion of a transfer member contact/releaser with the belt presser being pressed against the intermediate transfer belt.
Figure 5:
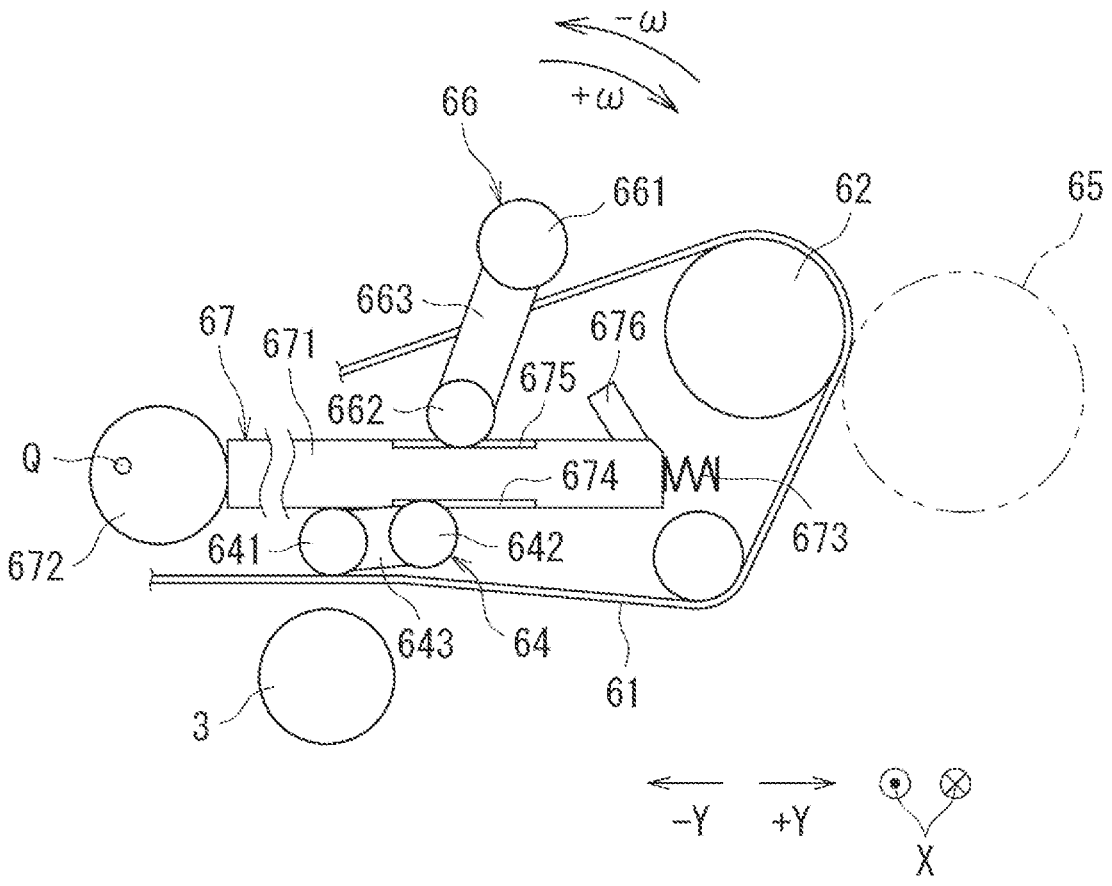
FIG. 5 is a schematic front view illustrating a portion of a transfer member contact/releaser with the belt presser being separated from the intermediate transfer belt.

FIG. 2 is a schematic front view illustrating a configuration of the transcriber 6 according to the embodiment 1. In FIG. 2, a transfer member contact/releaser 67 is not shown. FIG. 3 is a schematic plan view illustrating the intermediate transfer belt 61 and a belt presser 66. FIG. 4 is a schematic front view illustrating a portion of a transfer member contact/releaser 67 with the belt presser 66 being pressed against the intermediate transfer belt 61. FIG. 5 is a schematic front view illustrating a portion of the transfer member contact/releaser 67 with the belt presser 66 being separated from the intermediate transfer belt 61.

The transcriber 6 includes the intermediate transfer belt 61, a driving roller 62, a driven roller 63, the primary transfer member 64, the secondary transfer member 65, the belt presser 66, the transfer member contact/releaser 67, an image reader 68, an abutting member 69, and a belt cleaning unit 90 (see FIGS. 2, 4, and 5).

Intermediate Transfer Belt

The intermediate transfer belt 61 is an endless belt that is circulated in a rotation direction and is suspended on a driving roller 62 and a driven roller 63. The external surface of the intermediate transfer belt 61 is in contact with each of the image carriers 3. The toner images of the different colors formed on the image carriers 3 are superimposed in order on the intermediate transfer belt 61 to perform the primary transfer. The intermediate transfer belt 61 in the present embodiment is made from a film having about 50 μm to 150 μm in thickness.

The toner image formed on the intermediate transfer belt 61 consists of a toner image corresponding to the image data (i.e., the image to be finally transferred to the sheet P) and a toner image for a test TP. The toner image for a test TP is formed in the vicinity of both side edges of the intermediate transfer belt 61 (see FIG. 3) and is used to detect misalignment and concentration deviation of the toner image.

Driving Roller

The driving roller 62 is rotatably driven around a rotating shaft along the X direction by a drive unit (not shown), and located to contact a rear-side surface of the intermediate transfer belt 61. In the present embodiment, the driving roller 62 is provided on the right-end side of the transcriber 6 (see FIG. 2). The driving roller 62 serves so as to cause the intermediate transfer belt 61 to circulate.

Driven Roller

The driven rollers 63 (including 63*a*. 63*b*, 63*c* and 63*d*) are arranged along the intermediate transfer belt 61 with being rotatable freely (see FIG. 2). The driven roller 63 is rotated according to the circulation movement of the intermediate transfer belt 61.

Primary Transfer Member

Primary transfer members 64 (including 64*a*, 64*b*, 64*c*, and 64*d*) are arranged in a line along the Y direction so as to sandwich the intermediate transfer belt 61 between the image carriers 3 and the primary transfer members (see FIG. 2). Namely, the primary transfer members 64 (including 64*a*, 64*b*, 64*c*, and 64*d*) are disposed on the rear-side surface of the intermediate transfer belt 61. The primary transfer members 64 serve to transfer the toner images formed in the plurality of image formers U to the external surface of the intermediate transfer belt 61, respectively. When the toner image of the image carrier 3 is transferred to the intermediate transfer belt 61, a high-voltage transfer bias for transferring the toner image to the intermediate transfer belt 61, that is, a high-voltage transfer bias with a polarity (e.g., a positive polarity) reverse to a toner's charged polarity (e.g., a negative polarity), is applied to the primary transfer member 64.

The primary transfer members 64 (64*a*, 64*b*, 64*c*, and 64*d*) have transfer rollers 641 (641*a*, 641*b*, 641*c*, and 641*d*), roller rotating shaft 642 (642*a*, 642*b*, 642*c*, and 642*d*), and connection parts 643 (643*a*, 643*b*, 643*c*, and 643*d*), respectively. The transfer rollers 641 (641*a*, 641*b*, 641*c*, and 641*d*) and the roller rotating shafts 642 (642*a*, 642*b*, 642*c*, and 642*d*) are connected to each other by the connection parts 643 (643*a*, 643*b*, 643*c*, and 643*d*), respectively.

The transfer roller 641 brings the intermediate transfer belt 61 into contact with the image carrier 3 when performing the primary transfer, and is formed in a cylindrical shape along the X direction. On the outer peripheral surface of the transfer roller 641, there is provided an electrically conductive elastic material (e.g., a material made of EPDM, urethane foam and the like). This conductive elastic material makes it possible to uniformly apply a high voltage to the intermediate transfer belt 61.

The roller rotating shaft 642 is provided rotatably around its rotation axis along the X direction. By rotation of the roller rotating shaft 642, the transfer roller 641 is rotated around the roller rotating shaft 642. The roller rotating shaft 642 in the present embodiment is made of a metal shaft (e.g., stainless steel) having 8 mm to 10 mm in a diameter. A outer peripheral surface of the roller rotating shaft (342 has a gear-shaped circumferential surface.

The primary transfer member 64 is, of course, not limited to the configuration described above, and may be formed in a brush shape, for example.

Secondary Transfer Member

The secondary transfer member 65 is located so as to contact the external surface of the intermediate transfer belt 61 on the driving roller 62 (see FIG. 2), and serves to secondarily transfer onto the sheet P the toner image which has been primarily transferred onto the external surface of the intermediate transfer belt 61.

The transfer position T is a position where the intermediate transfer belt 61 and the secondary transfer member (35 come into contact with each other, and is the so-called transfer nip position (see FIG. 2). At the transfer position T, the intermediate transfer belt 61 is sandwiched between the driving roller 62 and the secondary transfer member 65. Furthermore, at the transfer position T, the sheet P is transferred while being sandwiched between the intermediate transfer belt 61 and the secondary transfer member 65. At this time, the toner image that has been transferred on the intermediate transfer belt 61 is transferred to the sheet P. In this way, the secondary transfer is performed.

In order to stably form the transfer nip position which is the transfer position T, one of the driving roller 62 and the secondary transfer member 65 may be formed from a hard material such as a metal roller or the like, and the other thereof may be formed from a soft material such as an elastic roller or the like (e.g., a soft material such as an elastic rubber or a foaming resin). Furthermore, on the outer peripheral surface of the secondary transfer member 65, there may be provided an electrically conductive elastic material (e.g., a material made of EPDM, urethane foam and the like). In the present embodiment, as the secondary transfer member 65 a secondary transfer roller having a predetermined outer diameter, on the surface of which a conductive elastic layer is formed, is employed.

The structure of the secondary transfer member 65 is not limited to the foregoing, and may be a structure in which a conductive belt is presses against the intermediate transfer belt 61 on the drive roller 62 by the secondary transfer roller having a conductive elastic layer formed on its surface (secondary belt transfer type).

In this embodiment, the outer diameter of the driving roller 62 is set to be smaller than that of the secondary transfer member 65 (i.e., secondary transfer roller). In other words, at the transfer position T, the outer peripheral surface of the driving roller 62 is bigger in curvature than that of the secondary transfer member 65. This results in an effect that a separation of the sheet P at the transfer position T from the outer peripheral surface of the driving roller 62 is promoted.

Belt Presser

The belt presser 66 is pressed against the intermediate transfer belt 61 on the downstream side from a position where the secondary transfer member 65 and the intermediate transfer belt 61 are in contact with each other in the circulation direction of the intermediate transfer belt 61 and from the external side of the intermediate transfer belt 61. The belt presser 66 has a pressing part 661 (661*b*, 661*c*, and 661*d*), a pressing part rotating shaft 662, and a connection part 663 (see FIG. 2). The pressing part 661 and the pressing part rotating shaft 662 are connected by the connection part 663.

The pressing part 661 is provided rotatably around its rotation axis along the X direction and pressed against the intermediate transfer belt 61. The pressing part 661 has a support shaft 661*a*, a first pressing part 661*b*, a second pressing part 661*c*, and a third pressing part 661*d* (see FIG. 3). The support shaft 661*a* has a cylindrical shape along the X direction. The first pressing part 661*b*, the second pressing part 661*c*, and the third pressing part 661*d* are coaxially attached to the outer peripheral surface of the support shaft 661*a*. The first pressing part 661*b* is provided near the end portion of the support shaft 661*a* on the −X direction side. The second pressing part 661*c* is provided near the end portion of the support shaft 661*b* in the +X direction. The third pressing part 661*d* is provided next to the second pressing part 661*c* in the +X direction.

The first pressing part 661*b*, the second pressing part 661*c*, and the third pressing part 661*d* are each formed like a crown shape such that a diameter gradually decreases as advancing to both ends thereof along the X direction. In the present embodiment, the crown amount (difference between the outer diameter of the center portion and the outer diameter of each of end portions of the pressing part) of the first pressing part 661*b*, the second pressing part 661*c*, and the third pressing part 661*d* is set to 0.6 mm. This crown amount is preferably between 0.0 and 0.6 mm.

The first pressing part 661*b*, the second pressing part 661*c*, and the third pressing part 661*d*, which are in contact with the intermediate transfer belt. 61 when the belt presser 66 is pressed against the intermediate transfer belt 61, are made of an elastic material (e.g., a rubber, an urethane foam or the like). This results in the effect that scratches on the intermediate transfer belt 61 caused by the belt presser 66 at the pressing are prevented.

In the present embodiment, the first pressing part 661*b*, the second pressing part 661*c*, and the third pressing part 661*d* are made of the urethane foam. The urethane foam contains lubricants such as a paraffin oil, a calcium carbonate or the like for the purpose of removing a nitrite compound accumulating on the intermediate transfer belt 61.

Between the first pressing part 661*b* and the second pressing part 661*c*, there is provided a belt contact avoiding part 661*e* to avoid contact with the intermediate transfer belt 61 (see FIG. 3). Similarly, between the second pressing part 661*c* and the third pressing part 661*d*, there is provided a belt contact avoiding part 661*f* to avoid contact with the intermediate transfer belt 61 (see FIG. 3). The belt contact avoiding part 661*e* is provided at a position corresponding to the toner image for a test TP which is formed on the intermediate transfer belt 61 on the −X direction side in the X direction, and the belt contact avoiding part 661*f* is provided at a position corresponding to the toner image for a test TP which is formed on the intermediate transfer belt 61 on the +X direction side in the X direction (see FIG. 3).

Namely, the pressing part 661 in the belt presser 66 is formed so that despite in contact with the intermediate transfer belt 61, the pressing part 661 is out of contact with the toner image for a test TP formed on the intermediate transfer belt 61. Since the belt presser 66 is not contact with the toner image for a test TP, the toner image for a test TP is not erased by the belt presser 66, and thus making it possible to read the toner image for a test TP even on the downstream side of the belt presser 66 in the circulation direction of the intermediate transfer belt 61.

The pressing part rotating shaft 662 is provided rotatably around its rotation axis along the X direction. By rotation of the pressing part rotating shaft 662, the pressing part 661 is rotated around the pressing part rotating shaft 662. The pressing part rotating shaft 662 in the present embodiment is made of a metal shaft (e.g., stainless steel) having 8 mm to 10 mm in a diameter. A outer peripheral surface of the pressing part rotating shaft 662 has a gear-shaped circumferential surface.

The configuration of the belt presser 66 is not limited to the foregoing, the pressing part 661, the pressing part rotating shaft 662, and the connection part 663 may be integrally molded, for example. The pressing part 661 may be a non-rotator.

Transfer Member Contact/Releaser

The transfer member contact/releaser 67 is provided on the internal side of the intermediate transfer belt 61, and serves to bring the primary transfer member (34 close to the image carrier 3 when the primary transfer is performed, and keep the primary transfer member 64 away from the image carrier 3 when primary transfer is not performed.

The transfer member contact/releaser 67 has a link plate 671, an eccentric cam 672, a biasing member 673, a first rack gear 674, a second rack gear 675, and a stopper 676 (see FIGS. 4 and 5).

The link plate 671 is provided to extend along the Y direction. The eccentric cam 672 is an eccentric rotator rotatable around an eccentric rotating shaft Q along the X direction, and is provided in the left direction from the link plate 671. The eccentric cam 672 is driven by an eccentric cam driving unit (not shown).

The biasing member 673 is supported by a main frame of the body (not shown), and applies force to the link plate 671 from the right side of the link plate 671. The biasing member 673 is composed of a coil spring, for example. The link plate 671 is pressed against the eccentric cam 672 by the biasing member 673. The rotation of the eccentric cam 672 causes the link plate 671 to reciprocally move along the Y direction.

The first rack gears 674 is arranged in a line along a bottom surface of the link plate 671 so as to mesh with the roller rotating shafts 642 (642*a*, 642*b*, 642*c*, and 642*d*) of the primary transfer member 64 (see FIGS. 4 and 5). The second rack gear 675 is provided at the right upper edge of the link plate 671 so as to mesh with the pressing part rotation shaft 662 of the belt presser 66 (see FIGS. 4 and 5). The stopper 676 is provided on the right side of the second rack gears 675 (see FIGS. 4 and 5) and serves to prevent excess rotation of the belt presser 66.

The first rack gear 674, the second rack gear 675, and the stopper 676 may be formed separately from the link plate 671 or may be formed integrally with the link plate 671.

Now, an operation of the primary transfer member 64 and the belt presser 66 by the transfer member contact/releaser 67 is described below.

When the eccentric cam 672 is rotated so that the eccentric rotating shaft Q of the eccentric cam 672 approaches the link plate 671, the link plate 671 is forced to move toward the eccentric rotating shaft Q along −Y direction (see FIG. 4).

As the link plate 671 moves in the −Y direction, the roller rotating shaft 642, which meshes with the first rack gear 674 of the link plate 671, is rotated in a −ω direction (i.e., a counterclockwise direction viewed along the +X direction) (see FIG. 4). The transfer roller 641, which is connected to the roller rotating shaft 642 via the connection part 643, is rotated around the roller rotating shaft 642 in the −ω direction (i.e., a counterclockwise direction when viewed along the +X direction). As the transfer roller 641 rotates in the −ω direction, the transfer roller 641 is brought close to the image carrier 3.

Furthermore, as the link plate 671 moves in the −Y direction, the pressing part rotating shaft 662, which meshes with the second rack gear 675 of the link plate 671, is rotated in a +ω direction (i.e., a clockwise direction viewed along the +X direction). The pressing part 661, which is connected to the pressing part rotating shaft 662 via the connection part 663, is rotated around the pressing part rotating shaft 662 in the +ω direction (i.e., a clockwise direction when viewed along the +X direction). As the pressing part 661 rotates in the +ω direction, the pressing part 661 is pressed against the external surface of the intermediate transfer belt 61 from the external side of the intermediate transfer belt 61.

On the other hand, when the eccentric cam 672 is rotated so that the eccentric rotating shaft. Q of the eccentric cam 672 leaves the link plate 671, the link plate 671 is forced to move away from the eccentric rotating shaft Q along +Y direction (see FIG. 5).

As the link plate 671 moves in the +Y direction, the roller rotating shaft 642, which meshes with the first rack gear 674 of the link plate 671, is rotated in the +ω direction a clockwise direction viewed along the +X direction) (see FIG. 5). The transfer roller 641, which is connected to the roller rotating shaft 642 via the connection part. 643, is rotated around the roller rotating shaft 642 in the +ω direction (i.e., a clockwise direction when viewed along the +X direction). As the transfer roller 641 rotates in the +ω direction, the transfer roller 641 is released from the image carrier 3.

Furthermore, as the link plate 671 moves in the +Y direction, the pressing part rotating shaft 662, which meshes with the second rack gear 675 of the link plate 671, is rotated in a −ω direction (i.e., a counterclockwise direction viewed along the +X direction). The pressing part 661, which is connected to the pressing part rotating shaft 662 via the connection part 663, is rotated around the pressing part rotating shaft 662 in the −ω direction (i.e., a counterclockwise direction when viewed along the +X direction). As the pressing part 661 rotates in the −ω direction, the pressing part 661 is released from the intermediate transfer belt 61.

As described above, since the transfer member contact/releaser 67 has the second rack gear 675 which meshes with the pressing part rotating shaft 662, the belt presser 66 is pressed against or released from the intermediate transfer belt 61 by the transfer member contact/releaser 67. This results in the effect that the structure of the transcriber 6 is simplified as well as the number of parts is reduced as compared to the case where the mechanism for operating the belt presser 66 is provided independent of the transfer member contact/releaser 67.

Of course, the structure of the transfer member contact/releaser 67 is not limited to the foregoing, and a mechanism for operating the belt presser 66 may be provided independent of the transfer member contact/releaser 67.

Image Reader

The image readers 68 are provided on the downstream side from the belt presser 66 in the circulation direction of the intermediate transfer belt 61 and above and near both side edges of the external surface of the intermediate transfer belt 61 (see FIGS. 2 and 3). The image reader 68 serves to read the toner image for a test TP. The image reader 68 employs an image sensor (e.g., a reflective-type sensor). A detected information of the toner image for a test read by the image reader 68 is used to adjust the timing that the exposure device 1 writes an electrostatic latent image on each image carrier 3. In other words, when toner images are transferred in order from each of image carriers 3 onto the intermediate transfer belt 61, the writing timing of the electrostatic latent image is adjusted by a controller (not shown) so that no displacement occurs in the transferred images. The detected information of the toner image for a test may be used to adjust the amount of toner adhered to the electrostatic latent image in the developing device 2.

Abutting Member

The abutting member 69 is provided on the downstream side from the belt presser 66 in the circulation direction of the intermediate transfer belt (31, and abutted on the internal surface of the intermediate transfer belt 61 from the internal side of the intermediate transfer belt 61 (see FIG. 2). The abutting member 69 is made of a metal plate (e.g. a general steel material such as a stainless steel, a galvanized steel sheet or the like). For example, a raising material, a Teflon® sheet or the like may be provided on the surface of the abutting member 69 to reduce friction force between the abutting member 69 and the intermediate transfer belt 61.

The belt presser 66 is pressed against the external surface of the intermediate transfer belt 61, while the abutting member (39 is abutted on the internal surface of the intermediate transfer belt 61 from the internal side of the intermediate transfer belt 61. It results in an effect that since tension of the intermediate transfer belt 61 is heightened by the belt presser 66 and the abutting member 69, the dynamic friction force against the circulation movement of the intermediate transfer belt 61 increases at a contact surface between the intermediate transfer belt 61 and the belt presser 66.

In the present embodiment, the belt presser 66 is pressed against the intermediate transfer belt 61 on the downstream side from the driving roller 62 in the circulation direction of the intermediate transfer belt 61 and on the upstream side from the abutting member 69 in the circulation direction of the intermediate transfer belt 61. The driving roller 62 is abutted on the internal surface of the intermediate transfer belt 61, the belt presser 66 is pressed against the external surface of the intermediate transfer belt 61, and the abutting member 69 is abutted on the internal surface of the intermediate transfer belt 61. When the belt presser 66 is pressed against the intermediate transfer belt 61, the tension of the intermediate transfer belt 61 is additionally increased by the driving roller 62, the belt presser 66, and the abutting member 69.

In the present embodiment, the abutting member 69 is located at a position opposed to the image reader 68. Furthermore, a portion of the abutting member 69, which is in contact with the intermediate transfer belt 61, is formed like a flat surface. Namely, since a shape of the intermediate transfer belt 61 at the position opposed to the image reader 68 is maintained like a flat surface, it makes the toner image for a test TP formed on the intermediate transfer belt 61 easy to read by the image reader 68.

Belt Cleaning Unit

The belt cleaning unit 90 is provided on the downstream side from the image reader 68 in the circulation direction of the intermediate transfer belt 61 (see FIG. 2). The belt cleaning unit 90 serves to remove the toner image remaining on the intermediate transfer belt 61. Since the toner image remaining on the intermediate transfer belt 61 is removed by the belt cleaning unit 90, a toner-color mixing in the next step can be prevented.

The belt cleaning unit 90 has a cleaning blade 91 and a cleaning roller 92.

The cleaning blade 91 is provided so that a tip portion thereof is in contact with the external surface of the intermediate transfer belt 61. The cleaning roller 92 is provided so that it is contact with the internal surface of the intermediate transfer belt 61 at a position opposed to the tip portion of the cleaning blade 91. The intermediate transfer belt 61 is sandwiched between the cleaning blade 91 and the cleaning roller 92. As the intermediate transfer belt 61 rotates, the toner image remaining on the intermediate transfer belt 61 is scraped off from the intermediate transfer belt 61 by the cleaning blade 91.

Operation of the Belt Presser

Next, operation of the belt presser 66 in the transcriber 6 having the above mentioned configuration is described.

Figure 6:
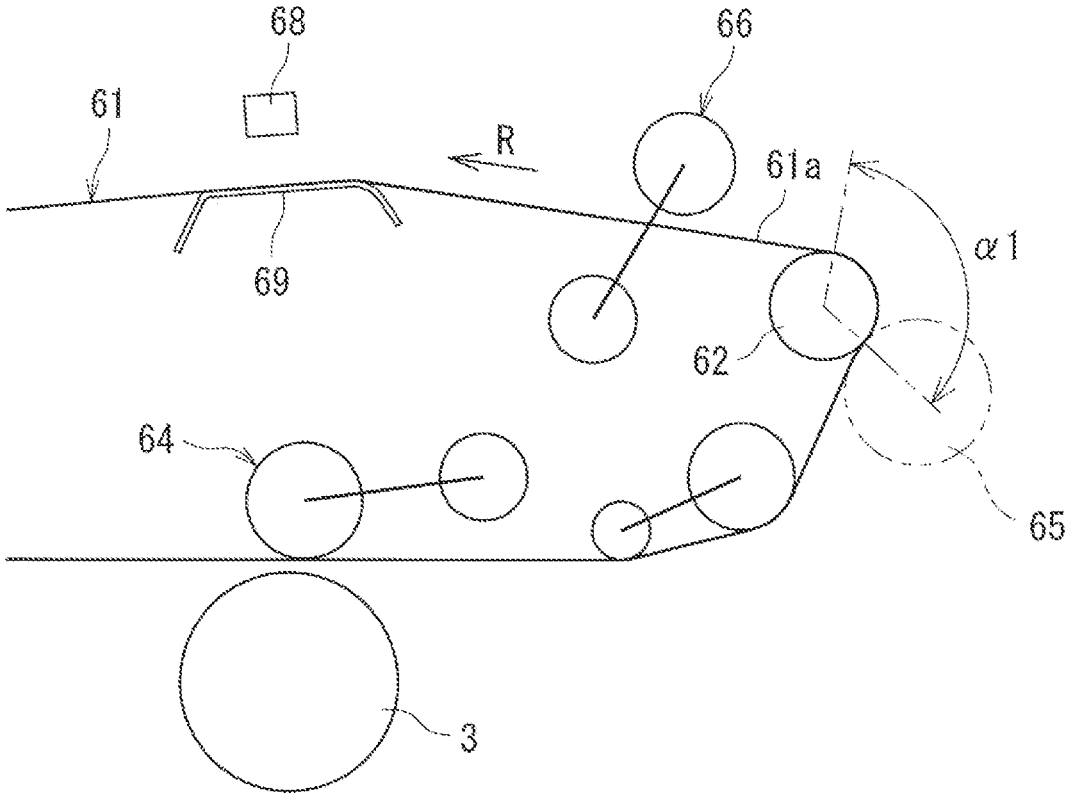
FIG. 6 is a schematic front view illustrating the intermediate transfer belt and the driving roller with the belt presser leaving the intermediate transfer belt.
Figure 7:
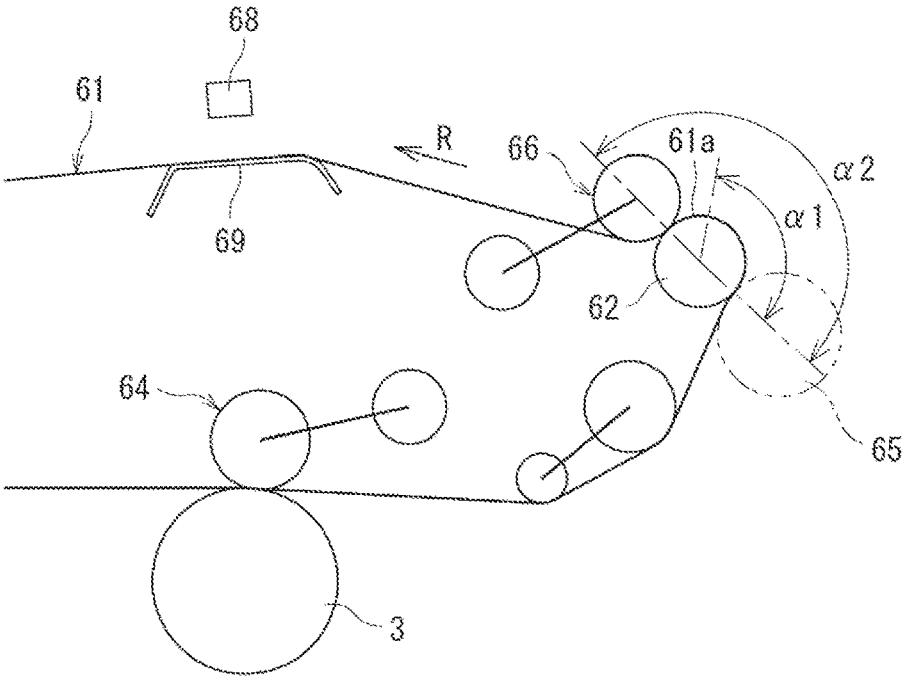
FIG. 7 is a schematic front view illustrating the intermediate transfer belt and a driving roller with the belt presser being pressed against the intermediate transfer belt.

FIG. 6 is a schematic front view illustrating the intermediate transfer belt 61 and the driving roller 62 with the belt presser 66 leaving from the intermediate transfer belt 61. FIG. 7 is a schematic front view illustrating the intermediate transfer belt 61 and the driving roller 62 with the belt presser 66 being pressed against the intermediate transfer belt 61.

First, the operation of the belt presser 66 when forming the image is described. Here, "when forming the image" refers to when the primary transfer is being performed, and "when not forming the image" refers to before or after the primary transfer is performed.

When forming the image, as the link plate 671 of the transfer member contact/releaser 67 is moved in the −Y direction by the rotation of the eccentric cam 672, the transfer roller 641 of the primary transfer member 64 is rotated in the −ω direction and thus is brought close to the image carrier 3. As the transfer roller 641 approaches the image carrier 3, the intermediate transfer belt 61 is brought into contact with the image carrier 3. In the state where the intermediate transfer belt 61 is in contact with the image carrier 3, a transfer bias is applied to the intermediate transfer belt 61 by the primary transfer member 64 as well as the toner image of the image carrier 3 is transferred onto the intermediate transfer belt 61.

Furthermore, when forming the image, as the transfer roller 641 of the primary transfer member 64 is brought close to the image carrier 3 by the rotation of the eccentric cam 672, the pressing part 661 of the belt presser 66 is rotated in the +ω direction and thus is pressed against the external surface of the intermediate transfer belt 61. By pressing the pressing part 661 against the intermediate transfer belt 61, a dynamic friction force against the circulation of the intermediate transfer belt is generated at the contact surface between the intermediate transfer belt 61 and the belt presser 66. As a result, the dynamic friction force generated against the rotation of the intermediate transfer belt 61 makes it possible to suppress a circulating slippage (slip) of the intermediate transfer belt 61.

When not forming the image, as the link plate 671 of the transfer member contact/releaser 67 is moved in the +Y direction by the rotation of the eccentric cam 672, the transfer roller 641 of the primary transfer member 64 is rotated in the +ω direction and thus leaves the image carrier 3.

Furthermore, when not forming the image, as the transfer roller 641 of the primary transfer member 64 leaves the image carrier 3 by the rotation of the eccentric cam 672, the pressing part 661 of the belt presser 66 is rotated in the −ω direction and thus is released from the intermediate transfer belt 61. In other words, when not forming the image, the load on the intermediate transfer belt 61 by the belt presser 66 is eliminated as compared to when forming the image. Accordingly; when forming the image, by generating the dynamic friction force against the circulation of the intermediate transfer belt 61 by pressing the belt presser 66 thereto, it results in effects that the slippage of the intermediate transfer belt 61 can be suppressed, as well as the preciseness of the image formation can be improved, on the other hand, when not forming the image, since the load on the intermediate transfer belt 61 is decreased by releasing the belt presser 66 therefrom, the deformation of the intermediate transfer belt 61 can be avoided, and thus a precise degradation of the image formation can be suppressed. In particular, since when not forming the image the belt presser 66 is released from the intermediate transfer belt 61, the deformation (e.g. curling) of the intermediate transfer belt 61 can be suppressed even after left for a long period of time.

In the present embodiment, by pressing the belt presser 66 to the intermediate transfer belt 61 a contact area between the intermediate transfer belt 61 and the driving roller 62 is increased. Specifically, it is as follows.

As shown in FIG. 6, when not forming the image, the intermediate transfer belt 61 and the driving roller 62 are in contact with each other at a circular-arc surface of a center angle $\alpha$1 (e.g., 122 degrees) of the driving roller 62. The intermediate transfer belt 61 is suspended in both tangential directions of the driving roller 62, which includes a tangential direction on the downstream side of the driving roller 62 in the circulation direction of the intermediate transfer belt 61. Hereinafter, a portion of the intermediate transfer belt 61, which is suspended in the tangential direction on the downstream side of the driving roller 62, is referred to as an intermediate transfer belt portion 61*a*. On the other hand, as shown in FIG. 7, when forming the image, the belt presser 66 is pressed against the external surface of the intermediate transfer belt portion 61*a* as well as the intermediate transfer belt portion 61*a* is brought close to the driving roller 62. As a result, when forming the image, the intermediate transfer belt 61 and the driving roller 62 are in contact with each other at a circular-arc surface of a center angle $\alpha$2 (e.g., 177 degrees) greater than the center angle $\alpha$1 of the driving roller 62. It results in an effect that the slippage of the intermediate transfer belt 61 is effectively suppressed since a larger contact surface area between the intermediate transfer belt 61 and the driving roller 62 is obtained, in other words, the contact surface area between the intermediate transfer belt 61 and the driving roller 62 is increased.

As mentioned above, in the present embodiment, the first pressing part 661*b*, the second pressing part 661*c*, and the third pressing part 661*d*, which are in contact with the intermediate transfer belt 61 when the belt presser 66 is pressed against the intermediate transfer belt 61, are made of an elastic material. Generally, in the case where the elastic material is pressed against the belt material for a long period of time, so-called oil bleed phenomenon in which the oil component contained in the elastic material exudes onto the belt material and then the oil component adheres to the belt material, is concerned. However, in the present invention, since the belt presser 66 is released from the intermediate transfer belt 61 when not forming the image, an occurrence of such oil bleeding phenomenon can be prevented.

Second Embodiment

Figure 8:
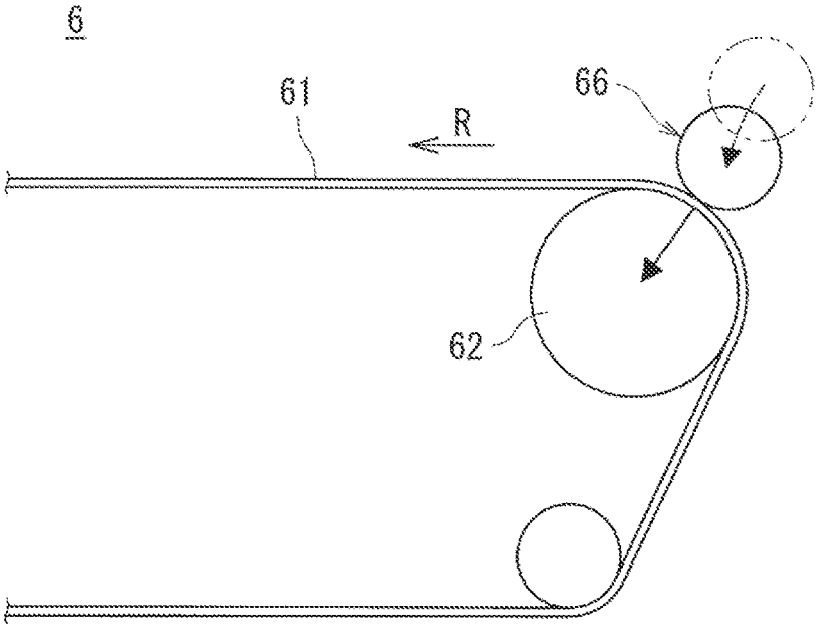
FIG. 8 is a schematic front view illustrating a portion of a configuration of a transcriber according to a second embodiment.

FIG. 8 is a schematic front view illustrating a portion of a configuration of the transcriber 6 according to a second embodiment.

In the second embodiment, when the belt presser 66 is pressed against the intermediate transfer belt 61, the belt presser 66 abuts on the driving roller 62 via the intermediate transfer belt 61 (see FIG. 8). By pressing the belt presser 66, the intermediate transfer belt 61 is sandwiched between the belt presser 66 and the driving roller 62. As a result, a stable contact between the belt presser 66 and the intermediate transfer belt 61 can be achieved, it results in an effect that the slippage of the intermediate transfer belt 61 can be effectively suppressed.

Furthermore, in the second embodiment, the belt presser 66 is pressed against the intermediate transfer belt 61 so as to direct toward the driving roller 62 (see FIG. 8). An orientation of normal force generated on the driving roller 62 by pressing the belt presser 66 to the driving roller 62 is nearly opposite to the pressing direction of the belt presser 66. As a result, since the intermediate transfer belt 61 is efficiently sandwiched by both the pressing force of the bell presser 66 and the normal force of the driving roller 62, it results in an effect that the slippage of the intermediate transfer belt 61 can be effectively suppressed.

Third Embodiment

Figure 9:
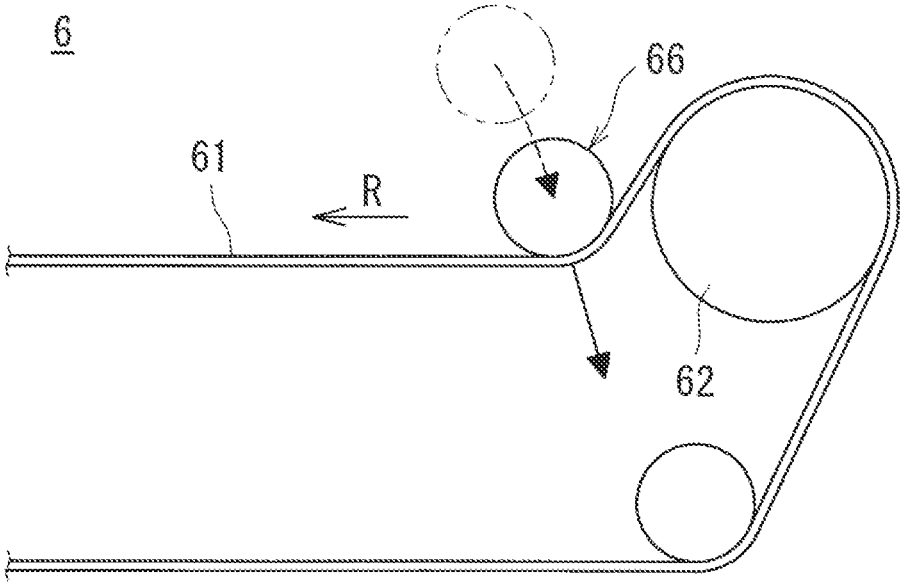
FIG. 9 is a schematic front view illustrating a portion of a configuration of a transcriber according to a third embodiment.

FIG. 9 is a schematic front view illustrating a portion of a configuration of the transcriber 6 according to a third embodiment.

In the third embodiment, the belt presser 66 is pressed against the intermediate transfer belt 61 on the downstream side from the contact area in which the intermediate transfer belt 61 and the driving roller 62 are in contact with each other in the circulation direction of the intermediate transfer belt 61 (see FIG. 9). Thereby, it results in an effect that a degree of freedom of a layout design is improved, since the belt presser 66 can be provided even when it is spatially difficult to locate the belt presser 66 in the vicinity of the driving roller 62.

It should be noted that the embodiments and alternatives disclosed herein are illustrated as only examples in all respects and are not intended to provide any basis for limited interpretation. Therefore, a technical scope of the present invention should be construed on the basis of a statement in the claims as attached hereto, not on the basis of the above mentioned embodiments and alternatives only. Furthermore, any changes and modifications within the meaning and range equivalent to the claims fall within the scope of the invention.

What is claimed is:

1. An image forming apparatus, comprising:

an endless intermediate transfer belt;

a driving roller being in contact with an internal surface of the intermediate transfer belt and to circulate the intermediate transfer belt;

a plurality of primary transfer members to respectively primarily transfer toner images formed by a plurality of image formers onto an external surface of the intermediate transfer belt;

a secondary transfer member disposed so as to abut on the external surface of the intermediate transfer belt on the driving roller and to secondarily transfer the toner images that are primarily transferred onto the external surface of the intermediate transfer belt onto a sheet; and a belt presser pressed against the intermediate transfer belt on a downstream side from a position where the secondary transfer member abuts on the intermediate transfer belt in a circulation direction of the intermediate transfer belt and from an external side of the intermediate transfer belt, wherein when the belt presser is pressed against the intermediate transfer belt, the belt presser is abutted to the driving roller via the intermediate transfer belt, and when not forming the images, the belt presser is released from the intermediate transfer belt.

2. The image forming apparatus according to claim 1, wherein the belt presser is pressed against the intermediate transfer belt so as to direct toward the driving roller.

3. The image forming apparatus according to claim 1, wherein a position where the belt presser is pressed against the intermediate transfer belt is on a downstream side from a contact area between the intermediate transfer belt and the driving roller in the circulation direction of the intermediate transfer belt.

4. The image forming apparatus according to claim 1, wherein when forming the images, a contact area between the driving roller and the intermediate transfer belt increases as compared to when not forming the images.

5. The image forming apparatus according to claim 1, wherein an elastic layer is provided at a portion of the belt presser that is pressed against the intermediate transfer belt.

6. The image forming apparatus according to claim 1 further comprising:

a transfer member contact/releaser to reciprocally move the plurality of primary transfer members in a direction approaching or leaving image carriers, respectively, wherein the belt presser is pressed against or released from the intermediate transfer belt by the transfer member contact/releaser.

7. The image forming apparatus according to claim 1, wherein the sheet is transported with being sandwiched between the intermediate transfer belt on the driving roller and the secondary transfer member, and an outer diameter of the driving roller is smaller than an outer diameter of the secondary transfer member.

8. The image forming apparatus according to claim 1 further comprising:

an abutting member provided on a downstream side from the belt presser in the circulation direction of the intermediate transfer belt, and abutted on the internal surface of the intermediate transfer belt.

9. The image forming apparatus according to claim 1 further comprising:

an image reader provided on a downstream side from the belt presser in the circulation direction of the intermediate transfer belt and to read a toner image for a test formed on the intermediate transfer belt, wherein the belt presser is not in contact with a portion where the toner image for the test is formed on the intermediate transfer belt.

* * * * *